US005220767A

United States Patent [19]

de Santana

[11] Patent Number: 5,220,767

[45] Date of Patent: Jun. 22, 1993

[54] DEVICE FOR APPLYING A CAP AND SEAL TO THE MOUTH OF A BOTTLE WHEREON AN INTERFERENCE BOSS IS PROVIDED FOR SAID SEAL

[75] Inventor: Gildete V. de Santana, São Paulo, Brazil

[73] Assignee: JBO Commercial Ltda., Brazil

[21] Appl. No.: 805,107

[22] Filed: Dec. 11, 1991

[30] Foreign Application Priority Data

Oct. 18, 1991 [BR] Brazil ..... PI9104593

[51] Int. Cl.[5] ..... B67B 3/20; B65B 7/28

[52] U.S. Cl. ..... 53/331.5; 53/353

[58] Field of Search ..... 53/353, 329, 331, 331.5, 53/201

[56] References Cited

U.S. PATENT DOCUMENTS

| | | | |
|---|---|---|---|
| 3,075,331 | 1/1963 | Stanley | 53/353 |
| 3,332,211 | 7/1967 | Koll et al. | 53/353 |
| 3,434,266 | 3/1969 | Wolf et al. | 53/353 |
| 3,470,667 | 10/1969 | David et al. | 53/201 X |
| 3,524,294 | 8/1970 | Koll | 53/353 X |
| 4,173,104 | 11/1979 | Koll | 53/201 |
| 4,771,588 | 9/1988 | Löfgren et al. | 53/353 X |

FOREIGN PATENT DOCUMENTS

| | | | |
|---|---|---|---|
| 1275860 | 5/1972 | United Kingdom | 53/353 |

*Primary Examiner*—Horace M. Culver

*Attorney, Agent, or Firm*—Merchant, Gould, Smith, Edell, Welter & Schmidt

[57] ABSTRACT

A "DEVICE FOR APPLYING A CAP AND SEAL TO THE MOUTH OF A BOTTLE WHEREON AN INTERFERENCE BOSS IS PROVIDED FOR SAID SEAL" comprising a cylindrical body [1] having upper means [2] for fitting it to a conventional machine so that the assembly may, simultaneously, be rotated and moved alternately upward and downward. Means [3] are provided on the inside thereof to enable stable penetration and ejection of a non-descript cap and seal, the latter being steadied by movable external means [4] duly protected by an outer enclosure [5]. In this way, a cap is screwed onto a conventional bottle with a seal coupled to an interference boss provided on the neck of the said bottle.

6 Claims, 2 Drawing Sheets

DEVICE FOR APPLYING A CAP AND SEAL TO THE MOUTH OF A BOTTLE WHEREON AN INTERFERENCE BOSS IS PROVIDED FOR SAID SEAL

FIELD OF THE INVENTION

This invention relates to a DEVICE FOR APPLYING A CAP AND SEAL TO THE MOUTH OF A BOTTLE WHEREON AN INTERFERENCE BOSS IS PROVIDED FOR SAID SEAL or, more specifically, to a genre of rotary head specially developed to provide increased speed and safety in the operation of closing bottles in general by means of caps and seals.

BACKGROUND OF THE INVENTION

As known to those skilled in the art, there are, today, innumerable types of plastic caps with incorporated seals that, though possibly displaying certain particular features, in the majority of cases are comprised of a cylindrical body, like an inverted cup, the lower edge of which skirt is provided with an incorporated girdle or ring, which ring is similar to a natural extension of the cylindrical portion of the cap but remains interconnected thereto by disjoinable parts, traditionally called bridges or links. Commonly, the cylindrical portion of the cap is provided with an internal screw thread, while the ring or seal is provided with a clasp or irreversible barb such cap suitably closes a nondescript bottle of a type having a mouth duly equipped with screw threads and, below these, an interference boss for the seal. That is, the cap is applied by being rotated until the ring or seal extends beyond the interference boss, whereupon the seal or ring is prevented from being removed again without having to undergo a change, that is, having to be broken, neutralizing its original shape and being partially or totally disjoined from the cap.

It is noted that the links or bridges comprise the most fragile part of the cap, obviously to facilitate manual opening of the flask and to provide evidence that the cap has been tampered with as a result of an attempted opening.

Due to seal's fragility, the cap must be applied correctly to the mouth of the bottler or, otherwise, premature partial or full cleavage of the seal may result.

SUMMARY OF THE INVENTION

The object of the present invention is to provide a device that assures safe application of the cap and its respective seal, thereby preventing premature cleavage of the bridges or links that join the ring to the body of the cap. Premature cleavage of the links or bridges occurs at the exact moment when the seal is overreaching the bottle's interference boss. At that stage in the operation of applying the cap, the links are compelled to endure two types of strains—axial and lateral. In other words, while the cap is rotating and sliding downwards, the seal is being forced to extend beyond the interference boss. The present invention was devised to meet a certain technical requirement, that is, to preserve the fragility of the links or bridges. In this regard, if the links or bridges wee designed to oversized dimensions, the problem of premature cleavage would be overcome for obvious reasons, but others would appear. That is, the oversized design would enable possible violation of the bottle.

The present invention comprises a rotary device that includes a set of pincers which engage the sealing ring directly, making it more stable and, therefore, causing the strain formerly endured by the links and bridges alone to be transferred to the entire lower edge of the cap.

DETAILED DESCRIPTION OF THE PREFERRED EMBODIMENT

Figure 2:
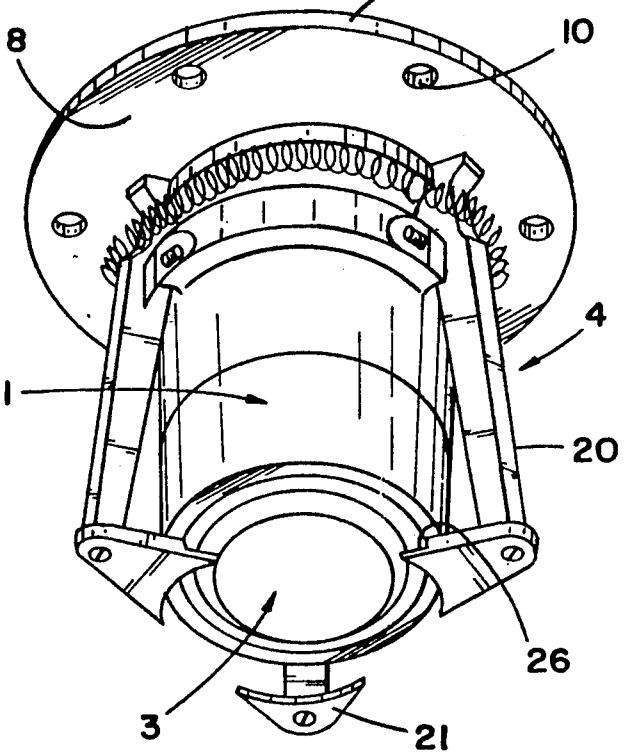
Figure 1:
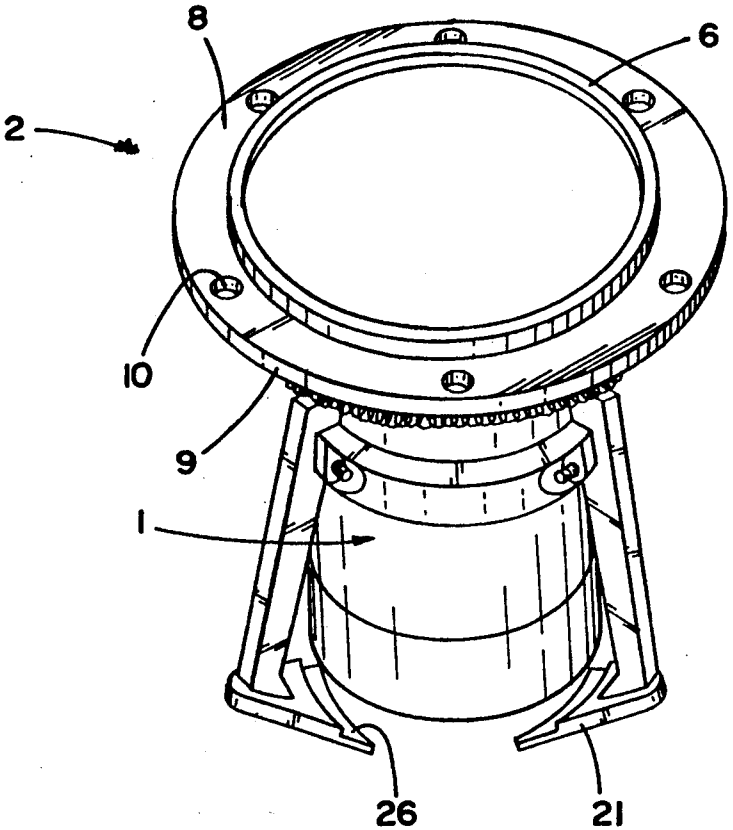
Figure 4:
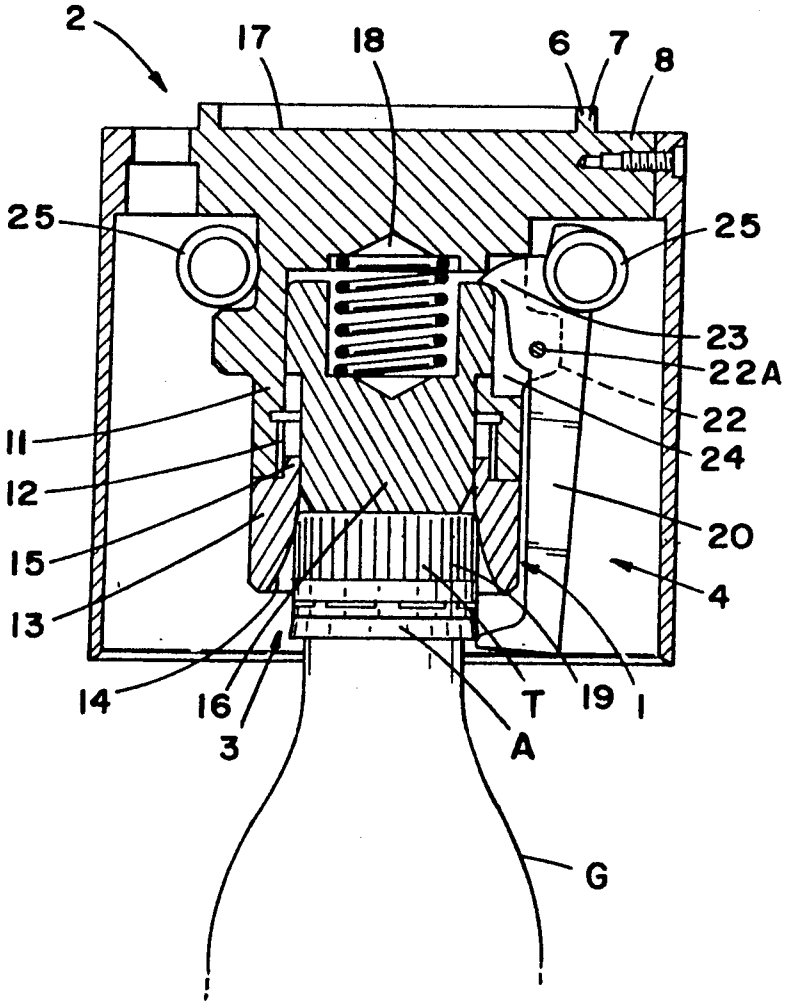
Figure 3:
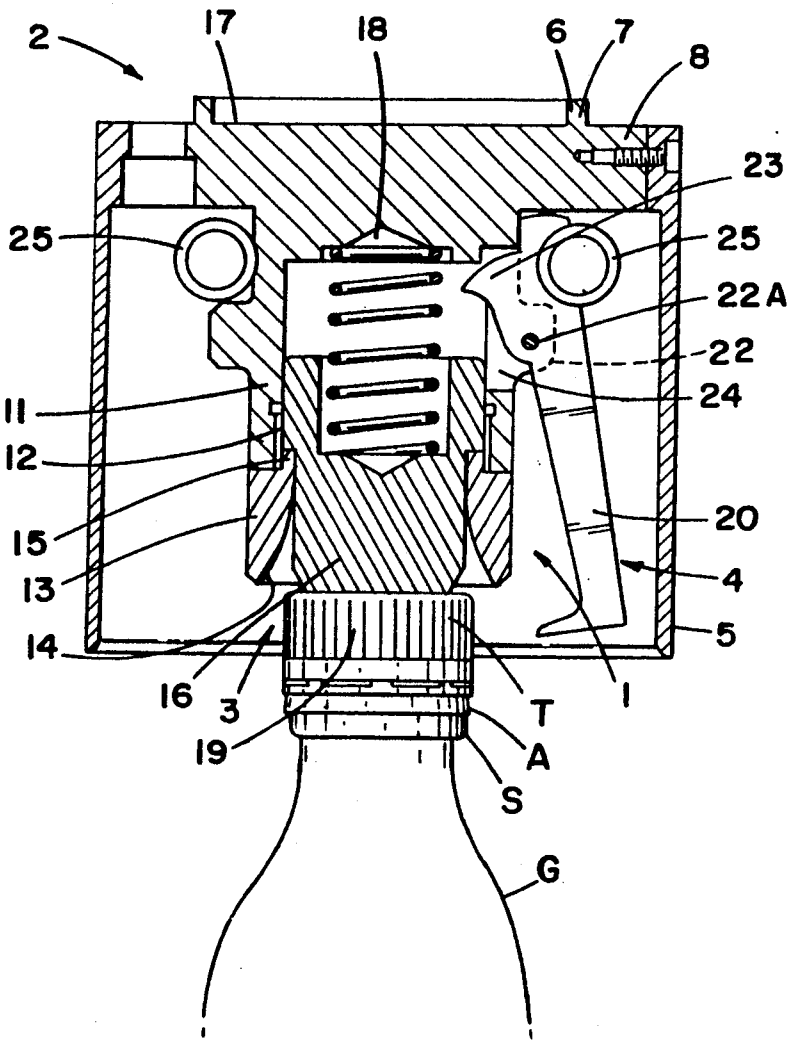

For a better understanding of the present invention, a detailed description is provided, with reference to the attached drawings, wherein:

FIG. 1 illustrates a perspective view from an upper angle in which the device's external details are featured;

FIG. 2 provides a similar view from a lower angle, in which other constructive details of the device area featured;

FIG. 3 is a side cutaway view, in which the device's inside details are featured; and FIG. 4 is the same view but illustrates the device's internal components when a cap is applied to a bottle.

According to these illustrations and details thereof, the present invention comprises a cylindrical body [1] having upper means [2] for fitting to a conventional machine so that the assembly simultaneously may be rotated and moved alternately upward and downward. Means [3] are also provided on the inside of the body to enable stable penetration and ejection of a nondescript cap and seal, the latter being steadied by movable external means [4] duly protected by an outer protector [5].

The upper means [2] includes an upper rim [6] and a respective sealing ring [7]. A blind flange [8] is also provided, together with respective radial [9] and axial [10] holes therein. The radial holes provide means for securing the cylindrical, cup-like skirt or protector [5], while the axial holes are used as required to attach the device to the conventional machine.

The penetration and ejection means [3] includes a cylindrical and practically tubular part [11] a mouthpiece (13), and a hammer (16). The tubular part (11) extends vertically from the lower face of blind flange [8]. The lower end of the tubular part is provided with inner threads [12] to which cylindrical mouthpiece [13] is coupled. The mouthpiece is slightly tapered and has a grooved inside diameter [14]. The inside diameter of the mouthpiece, is slightly smaller than the inside diameter of the tubular part [11], thereby providing a stop [15] for the larger diameter of the hammer [16]. The upper portion of the hammer is provided with a recess while the lower end (19) is horizontally flat. The recess houses the lower end of a coil spring [17]. The opposite extremity of the coil spring abuts a similar housing [18] provided on the lower surface of the blind flange [8]. In this way the hammer is biased normally downward, such that the smaller diameter of the hammer is housed within the mouthpiece [13]. In use, the larger diameter of the hammer slides within the cylindrical body [1] as the smaller diameter moves within the mouthpiece [13]. The lower end [19] abuts the top of cap (T).

The movable external means [4] comprises pincers in the form of vertical stems [20] with nearly L-shaped lower ends [21] and upper ends pivotingly secured to journal-like projections [22] provided on the cylindrical portion [11] with pivot pins [22A]. Above pivot pins [22A] the vertical stems [20] are provided with inwardly and widening arched inner edges which functions as progressive cam ends [23]. Cam ends [23] extend through windows or openings [24] provided on the walls of portion [11]. Cam ends [23] are normally biased inwardly by a spring or other elastic means [25]. Cam ends [23] are located in the path of hammer [16] so that the latter can engage said cams ends and thereby cause all the pincers to close at the same time.

L-shaped ends [21] are each made of an almost triangularly shaped plastic part. One corner of the part is secured under the stem [20], while the opposite edge is semicircular and includes a step [26]. Step [26] is turned inward and, together with the others, describes a circular section when the pincers are closed.

It should be appreciated, from the foregoing statements and illustrations, that this device is very simple indeed, both from the standpoint of its ease in being manufactured and its operation. That is, as said before, the assembly can be used with conventional bottling machinery or equipment. Conventional bottling machinery includes a type of machine that allows the device to be kept in continuous rotation and, at the same time, moves the device alternately upward and downward. In this way, the bottles to be closed with the cap already in place on the mouths can pass thereunder. Obviously, the bottles are also conveyed by a suitable system and, when instantly and exactly positioned under the device, such motions, inevitably, are combined so that the cap can penetrate into the grooved mouthpiece [13]. At that time various simultaneous and instantaneous events take place. First, the cap is aligned relative to the mouthpiece and rotated. There is consequent movement of the cap onto the neck of the bottle so that when the cap reached the full extend of its movement, there is penetration of the cap into the mouthpiece [13]. The hammer [16], inevitably engaged the cam ends [23] and caused the pincers [20] to close and, in turn, stabilize the ring or seal [A] until the seal overreached the interference boss [S] on the bottle [G]. After that the device returns to its original position and thus completes the cycle needed to assembly a cap. It is noted that pincers [4], hammer [16] and grooves [14] cooperate with one another to provide a perfect support for the parts of cap [T] so that the links and seal remain steady relative to the main body and so that the strain otherwise endured by the links or bridges alone is now evenly transferred to the entire periphery of the cap.

What is claimed is:

1. A device for applying to a mouth of a bottle a cap having an attached anti-tamper seal, said bottle including an interference boss, said device being attachable to a conventional machine which simultaneously rotates said cap and seal and moves said cap and seal downward during application to said mouth, said device comprising:

a cylindrical body having upper means for attaching to said machine;

means attached to said body for penetration by said cap, said penetration means including a hammer biased against said cap; and means attached to said body for stabilizing said seal during downward movement of said seal past said interference boss, said stabilizing means including means for contacting said hammer when said seal approaches said interference boss and means for moving steadying members into position to stabilize said seal as a result of said contacting means contacting said hammer.

2. The device in accordance with claim 1 including outer cylindrical means for protecting said stabilizing means.

3. The device in accordance with claim 2 wherein said upper means includes an upper rim and a sealing ring, said upper means also including a flange with radial and axial holes, wherein said radial holes are available for attaching said outer cylindrical means to said flange and said axial holes are available for attaching said device to said conventional machine.

4. The device in accordance with claim 1 wherein said upper means further includes a tubular part extending from said flange, said penetration means including a mouthpiece being attached to said tubular part, said hammer being retained within said tubular part by said mouthpiece, said penetration means further including a spring compressed between said flange and said hammer.

5. The device in accordance with claim 1 wherein said stabilizing means includes a plurality of pincers with upper and lower ends, said pincers being pivotably secured to said cylindrical body, said cylindrical body including openings, said upper ends extending through said openings for contact with said hammer, said stabilizing means further including means for biasing the upper ends of said pincers toward said openings.

6. The device in accordance with claim 5 wherein said lower ends have a curved edge concave toward the mouth of the bottle so that when said pincers are closed said edges form a circular support.

* * * * *